US007104936B2

(12) United States Patent
Karlstrom

(10) Patent No.: US 7,104,936 B2
(45) Date of Patent: Sep. 12, 2006

(54) STRENGTH AND POWER TRAINING SYSTEM

(76) Inventor: David D. Karlstrom, 6206-14th St. So., Moorhead, MN (US) 56560

( * ) Notice: Subject to any disclaimer, the term of this patent is extended or adjusted under 35 U.S.C. 154(b) by 334 days.

(21) Appl. No.: 10/445,535

(22) Filed: May 27, 2003

(65) Prior Publication Data

US 2004/0242383 A1 Dec. 2, 2004

(51) Int. Cl.
*A63B 21/00* (2006.01)

(52) U.S. Cl. ..... 482/137; 482/112; 482/135

(58) Field of Classification Search ..... 482/112, 482/111, 106–108, 137, 104, 105
See application file for complete search history.

(56) References Cited

U.S. PATENT DOCUMENTS 3,822,599 A 7/1974 Brentham ..... 73/379
4,241,913 A 12/1980 Zwayer et al.
4,353,547 A * 10/1982 Jenkinson ..... 482/113
4,357,010 A * 11/1982 Telle ..... 482/97
4,448,412 A * 5/1984 Brentham ..... 482/112
4,482,152 A 11/1984 Wolff
4,667,955 A 5/1987 Giesch
4,750,739 A 6/1988 Lange
4,863,161 A 9/1989 Telle
4,872,668 A 10/1989 McGillis et al.
5,496,238 A 3/1996 Taylor ..... 482/63

* cited by examiner

*Primary Examiner*—Jerome Donnelly
(74) *Attorney, Agent, or Firm*—Nickolas E. Westman; Westman, Champlin & Kelly, P.A.

(57) ABSTRACT

A weight machine is used for acceleration movement of heavy weights, and jumping and throwing exercises. The weight machine includes a hydraulic cylinder that will retard movement of the weight under gravity, and will permit free movement against the force of gravity.

9 Claims, 2 Drawing Sheets

STRENGTH AND POWER TRAINING SYSTEM

BACKGROUND OF THE INVENTION

The present invention relates to a strength and power exercise machine that provides a system in which jumping and throwing exercises can be carried out safely with very low impact forces.

In the prior art, various types of weight training machines have been advanced, but generally they involve maintaining the weight under the control of the person exercising when both raising and lowering the weights. Jumping and throwing exercises where substantial weight is thrown rapidly involved high impact forces and weight limitations.

SUMMARY OF THE INVENTION

The present invention relates to a weight training apparatus that permits strength and power training with low impact forces. A weight machine that preferably is a squat/overhead press permits the user to grab the press handles or use the shoulder and throw the weight upwardly as rapidly as possible, or do other jumping and throwing exercises. The machine provides a controlled descent rate for the weight through the use of a hydraulic actuator that gives little or no resistance to upward movement of the weights, but controls the rate of descent to a safe level.

The weights can be mounted onto any type of weight support frame usually on an arm that pivots on a frame, and a hydraulic cylinder or actuator is used between the frame and the weight support arm. A check valve in the hydraulic circuit of the actuator permits free flow between opposite sides of the internal piston in one direction and a controlled bleed back in the other direction.

Specifically, as shown, the actuator has an internal sleeve with a piston. The piston has a check valve on it, so that when the cylinder is moved in a first direction, there is a free flow of hydraulic oil or fluid from one side of the piston to the other side, but upon movement in the opposite direction, the hydraulic oil that has to be displaced to permit such movement goes through a bleed passageway with a valve that controls the rate of flow so the movement of the piston is restricted to a desired rate. The check valve and bleed valve can be external as well.

The machine arrangement is reliable, and greatly increases the possibilities for power training by permitting jumping and throwing exercises that are based upon essentially free weight movement in one direction that can be done rapidly, and safely.

No spotters are required during the exercises, because the weight is maintained under control at all times, and the normal deceleration phase, which requires the athlete to catch and hold the weight during decent, is eliminated because the machine controls the descent of the weight.

Again, various types of weight machines can be provided with the actuator that controls the descent rate of the weight.

DETAILED DESCRIPTION OF THE PREFERRED EMBODIMENTS

Figure 1:
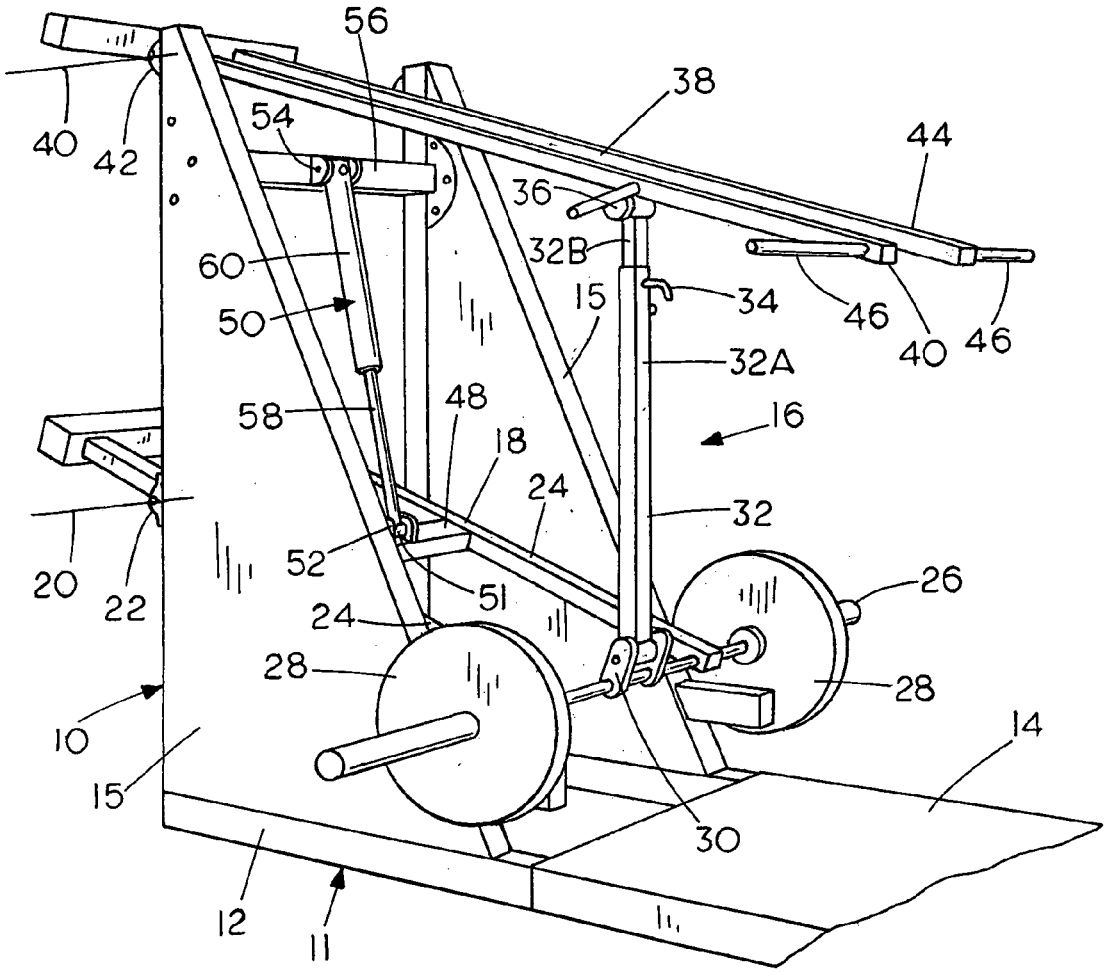
FIG. 1 is a perspective view of a typical overhead press system modified to use the present invention for explosive power training.

FIG. 1 illustrates an exercise machine 10 that is essentially a squat/overhead press, which includes a frame 11 having a base 12, and a platform 14 on which the person exercising will stand. The base 12 supports upright frame members 15 that are spaced apart and are used for supporting a weight system indicated generally at 16. The weight system includes a first weight support pivoting frame 18 that is pivotally mounted to the frame members 15 on an axis 20 on suitable bearings 22, in the normal manner. The bearings 22 are at the rear of the upright frame members 15. The first pivoting frame 18 includes parallel side members 24, 24 that support a weight shaft 26 that extends transversely, and on which a number of weights 28 can be mounted. Only one weight is shown on each side of the shaft 26, but additional weights can be added.

Any type of weight machine can be used where the weights are on a support that is mounted for movement on a frame, and wherein an actuator can be mounted between the support and the frame.

A connector bracket 30 is provided in the center of the shaft 26 between the frame members 24, and a link 32 is pivotally mounted at one end to the bracket 30 on a suitable pin. The link 32 is made so that it can be adjusted in length, in that it has an outer tube 32A and an inner telescoping tube 32B that can be adjusted in length using a suitable lock pin 34 that can pass through a selected one of a series of holes on the inner telescoping member.

The upper end of the link 32 is connected with a pivot connection 36 to a lift bar assembly 38. The lift bar assembly 38 is also pivotally mounted to upper ends of the frame members 15, about a horizontal axis 40. The axis 40 is parallel to axis 20. One bearing 42 is shown, but a bearing 42 on each frame member 15 is used to mount a suitable pivot mechanism for pivotally mounting the lift frame 38. The lift frame 38 also has a pair of side frame members 44, that are spaced apart and include handles 46 for the athlete doing the exercise.

The first pivot frame 18 includes a cross member 48 between the side frame members 24. The cross member 48 is positioned between the pivot axis 20 and the shaft 26. The cross member 48 is also spaced from the link 32. A hydraulic cylinder 50 has a rod end 51 pivotally mounted to the cross member on a suitable bracket 52. The hydraulic cylinder 50 has a base end 53 that is pivotally mounted on a pin 54 to a frame cross member 56 that is fixedly supported between the upright frame members 15.

The weights 28 are shown in a lowered position, which can be a stopped position, and as shown in FIG. 1, the hydraulic cylinder 50 is extended, with the rod 58 extending out of the cylinder body 60. Any suitable stop can be utilized for supporting the weights. The user stands on the platform 14, and grasps the handles 46 in a desired manner and throws the weights 28 upwardly by pushing on the frame 38 as it pivots about the axis 40. This will cause the weights to be lifted through the link 32 and compress or retract the rod 58 into the cylinder 60.

In operation, this throwing of the weights upwardly against the force of gravity is substantially unrestricted by the hydraulic cylinder. The user can actually let go of the weights and the hydraulic cylinder assembly 50 will control the descent of the weights under the force of gravity back to their stopped position for another throw by the athlete.

Figure 2:
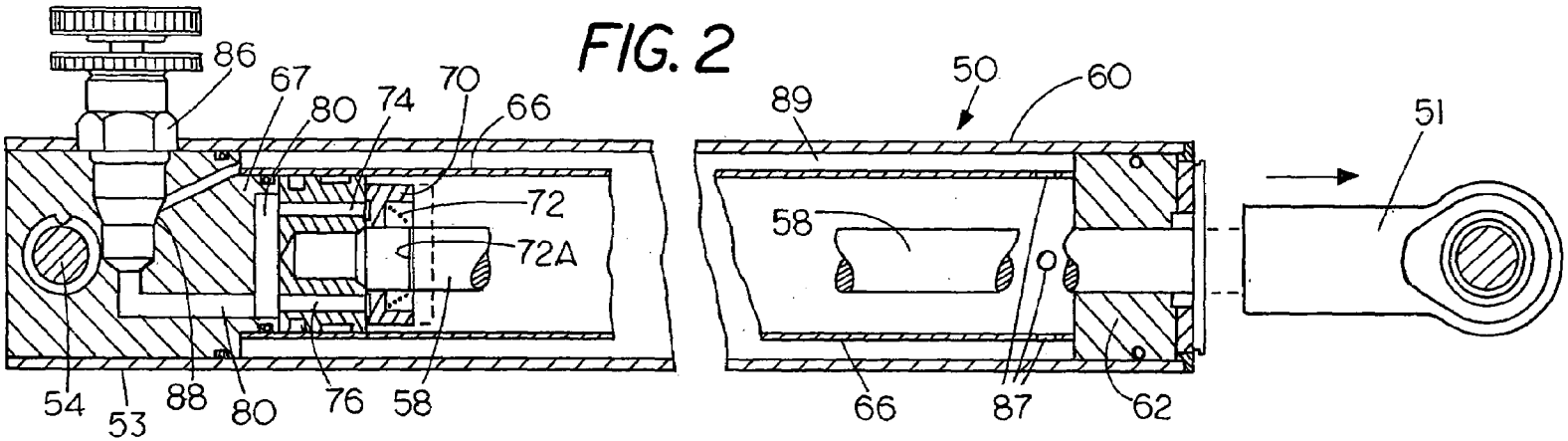
FIG. 2 is a vertical sectional view of a hydraulic control cylinder used for decelerating the weights and permitting them to return to a starting position.
Figure 3:
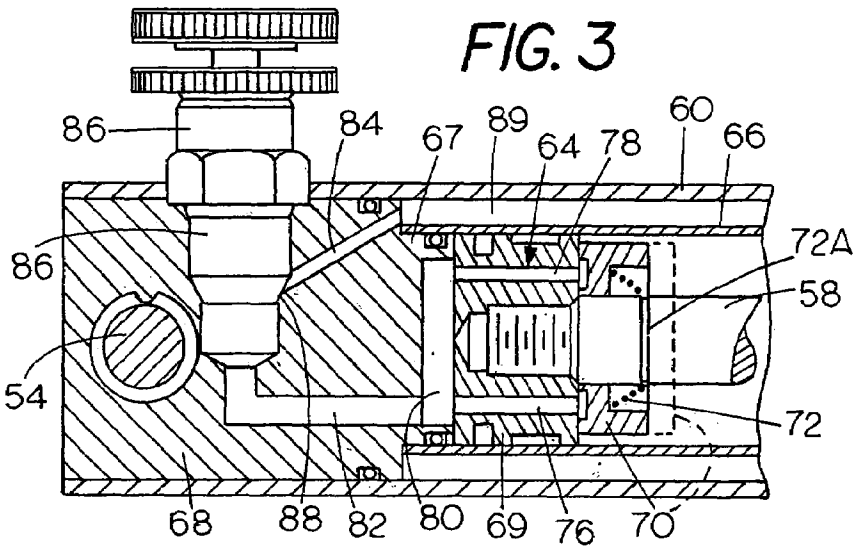
FIG. 3 is an enlarged sectional view of the piston portion of the cylinder shown in FIG. 2.

In FIG. 2, a longitudinal sectional view of the cylinder assembly 50 is illustrated. The outer cylinder tube 60 and the rod 58 are illustrated in a retracted or compressed position with the rod inside the cylinder. The rod 58 is suitably sealed with a retainer plug 62 on the outer end of the cylinder. The rod 58 carries a piston and check valve assembly 64 on the interior of an inner cylinder tube 66 that is held on the end block 62, and also is supported on pilot neck 67 on a base end block 68. That closes the base end of the cylinder tube 60. The base end block also supports the pin 54. The piston and check valve assembly 64 includes a piston 69 that mates with check valve plate 70 that is mounted on the rod 58, and is spring loaded with a conical spring 72 toward the piston 74. The piston 69 is fixed on the rod 58 and moves with the rod. It can be seen that the check valve plate 70 is slidable on the rod 58, and will move to the dotted line position shown in FIG. 3 against the force of the spring 72 under differential hydraulic pressure caused as the weights are lifted or thrown up. The check valve plate opens as the extended rod 58 is moved inwardly to uncover passageways 76 and 78 in the piston 74. The spring 78 surrounds rod 58 and fits in a recess in the check valve plate. The spring is held from sliding on the rod with a snap ring 72A.

The end pilot neck 67 of block 68 has a chamber 80, to permit flow between the passageways 76 and 78. The interior cylinder 66 is filled with oil and the annular chamber 89 between the inner cylinder 66 and outer tube 60 is also filled with hydraulic oil. When the rod 58 extends to permit the weights to lower, the check valve plate is closed against the piston to prevent oil from flowing through the passageways in the piston. The oil is pressurized and flow out one or more openings 87 in the tube 66 and into the chamber 89, which cause pressure in the chamber 89. The block 68 also has a passage 82, connected to a passageway 84 through a throttle valve assembly 86, that can be adjusted to control the orifice opening 88 from the passage 82 to the passage 84. The oil must flow through passageways 84 and 82 across orifice 88. The rate of flow is controlled by the throttle valve 86. The speed at which the cylinder rod extends under the force of gravity acting on weights 28 is capable of being controlled.

Figure 4:
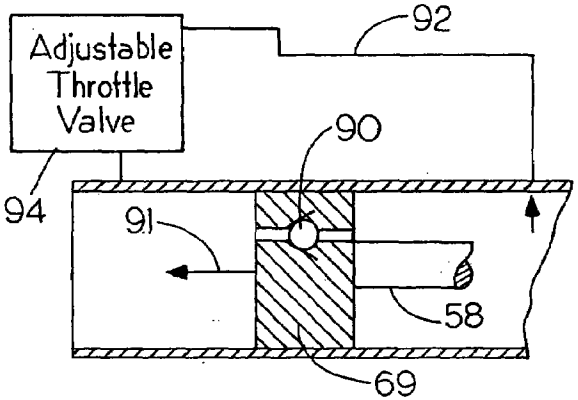
FIG. 4 is a schematic representation of an equivalent hydraulic control circuit used with the present invention.

A schematic representation of this hydraulic circuit arrangement is shown in FIG. 4, and in this case, the piston rod 58 is shown schematically along with the piston 69. A check valve is represented at 90, and will permit free flow through the check valve to the rod end of the cylinder when the piston is moved in the direction of arrow 91. When the cylinder rod is loaded to extend again in opposite direction, the check valve 90 closes, and the fluid that comes out of the rod end of the cylinder has to go through a passage represented at line 92 and through throttle valve 94, which is adjustable, and can control a rate of flow of non-compressible fluid (hydraulic oil) so that the rate of descent or movement of the rod 58 can be adjusted and controlled.

Suitable seals to prevent leakage are provided, as necessary.

Although the present invention has been described with reference to preferred embodiments, workers skilled in the art will recognize that changes may be made in form and detail without departing from the spirit and scope of the invention.

What is claimed is:

1. A weight throwing machine comprising a frame, a weight support pivotally mounted on said frame, a handle for grasping for throwing the weight upwardly, and a reaction actuator connected between the frame and the pivoting weight support, said reaction actuator comprising a fluid pressure cylinder and piston having a check valve which permits substantially free flow from one side of the piston to a second side of the piston during upward throwing movement of the weight support, and an internal passageway in the fluid pressure cylinder including a restriction to control the flow from a second side of the piston to the one side when the weight support is released, to slow a rate of falling of the weight support under gravity, wherein said fluid pressure cylinder comprises a hydraulic actuator having a pair of concentric cylinders, an inner cylinder slidably mounting the piston and an outwardly extending rod attached to the piston, an annular space defined between the inner cylinder and an outer cylinder of the concentric cylinders, and an opening between the inner cylinder and outer cylinder on the second side of the piston, adjacent an outer end of the fluid pressure cylinder, said restriction comprising a passageway in a base end of the outer cylinder opposite from the outer end of the fluid pressure cylinder from which the rod extends and forming a flow passage between the annular space and the one side of the piston.

2. The weight machine of claim 1, wherein said weight support is pivotally mounted to said frame at a first level adjacent a supporting surface, and an operator lift bar pivotally mounted to the frame and spaced vertically above the weight support, the handle being connected to the lift bar, and a link connecting the lift bar and the lift support, whereby when the lift bar is moved, the weight support is also moved.

3. The machine of claim 1, wherein said handle comprises an elongated handle pivotally mounted to the frame about an axis parallel to and spaced from the pivotal mounting of the weight support, said handle extending outwardly over a weight on the weight support, and a link between the handle and the weight support such that when the handle is moved about its pivot, the weight support moves about its pivot in the same direction.

4. The machine of claim 3, wherein said restriction comprises an adjustable orifice in the flow passage between the second side of the piston and the one side of the piston.

5. The machine of claim 1, wherein said restriction comprises an adjustable member that controls the size of an orifice through which fluid flows from the second side of the piston to the one side of the piston.

6. The machine of claim 5, wherein the adjustable member comprises a manually adjustable valve that moves a valve member relative to a valve seat surrounding the orifice.

7. A weight throwing machine comprising a frame, a weight support pivotally mounted on said frame, a handle for grasping for throwing the weight upwardly, and a reaction actuator connected between the frame and the pivoting weight support, said reaction actuator comprising a fluid pressure cylinder and piston having a check valve which permits substantially free flow from one side of the piston to a second side of the piston during upward throwing movement of the weight support, and an internal passageway in the fluid pressure cylinder including a restriction to control the flow from a second side of the piston to the one side when the weight support is released, to slow a rate of falling of the weight support under gravity, said check valve comprising a valve plate on the second side of the piston, the piston having a passageway that is closed by the valve plate under a spring load, but which opens when the pressure on the one side of the piston exceeds a selected amount to move the valve plate away from the second side of the piston.

8. The machine of claim 7, wherein the spring load is provided with a conical spring.

9. The machine of claim 7, wherein said fluid pressure cylinder has a block at the base end thereof, the block having a recess that faces the piston, and connects the passageway in the piston to a passageway forming the portion of the restriction.

* * * * *